United States Patent [19]

Aoyama

[11] 4,165,722

[45] Aug. 28, 1979

[54] EXHAUST GAS RECIRCULATION CONTROL SYSTEM

[75] Inventor: Syunichi Aoyama, Yokohama, Japan

[73] Assignee: Nissan Motor Company, Limited, Japan

[21] Appl. No.: 851,190

[22] Filed: Nov. 14, 1977

[30] Foreign Application Priority Data

Nov. 15, 1976 [JP] Japan ..... 51/152145[U]

[51] Int. Cl.[2] ..... F02M 25/06

[52] U.S. Cl. ..... 123/119 A; 74/860; 180/178

[58] Field of Search ..... 123/119 A, 102; 74/860, 74/856; 180/105 E

[56] References Cited

U.S. PATENT DOCUMENTS

| | | | |
|---|---|---|---|
| 4,013,052 | 3/1977 | Nasaki et al. | 123/119 A |
| 4,056,083 | 11/1977 | Wakita | 123/119 A |
| 4,056,084 | 11/1977 | Baumgartner | 123/119 A |
| 4,069,797 | 1/1978 | Nohira et al. | 123/119 A |
| 4,071,003 | 1/1978 | Aono | 123/119 A |
| 4,073,202 | 2/1978 | Aoyama et al. | 123/119 A |
| 4,112,894 | 9/1978 | Nohira | 123/119 A |
| 4,116,181 | 9/1978 | Nakajima et al. | 123/119 A |
| 4,124,004 | 11/1978 | Aoyama | 123/119 A |

*Primary Examiner*—Wendell E. Burns

*Attorney, Agent, or Firm*—Robert E. Burns; Emmanuel J. Lobato; Bruce L. Adams

[57] ABSTRACT

A multiple spark plug ignition internal combustion engine is equipped with an EGR control system which consists of an EGR control valve disposed in an EGR passageway connecting an exhaust gas passageway and an intake passageway. The EGR control system is arranged to control EGR rate in accordance with venturi vacuum and in accordance with the exhaust gas pressure in the EGR passageway upstream of the EGR control valve. The EGR control system comprises a device for decreasing the EGR rate under a suburban area cruising condition of a motor vehicle on which the engine is mounted.

17 Claims, 3 Drawing Figures

EXHAUST GAS RECIRCULATION CONTROL SYSTEM

BACKGROUND OF THE INVENTION

This invention relates to an improvement of an EGR (Exhaust Gas Recirculation) control system for controlling recirculating a portion of the exhaust gases passing through the exhaust passageway of an internal combustion engine back to the combustion chamber of the same.

It is well known in the art that a part of the exhaust gases of an internal combustion engine is recirculated back to the combustion chamber of the engine in order to suppress the maximum temperature of the combustion taken place in the combustion chamber to reduce the emission level of nitrogen oxides (NOx) which are generated during the combustion in the combustion chamber. By virtue of this exhaust gas recirculation, the NOx emission level has thus effectively been lowered. However, the recirculated exhaust gas considerably affects the combustion in the combustion chamber and stability of the engine and therefore its amount is desired to be strictly controlled in response to engine operating conditions.

In this regard, the following EGR control system has been proposed by the same applicant as the present application: An EGR control valve is closeably disposed in an EGR passageway connecting an intake passageway and an exhaust passageway of an internal combustion engine. The EGR control valve is operated to control the exhaust gas recirculated back to the combustion chamber of the engine, which is accomplished by varying the exhaust gas pressure in the EGR passageway upstream of the EGR control valve in accordance with the variations of a venturi vacuum in the intake passageway. By this EGR control system, the recirculated gas flow is prevented from being affected by the variation of exhaust gas pressure in the EGR passageway. As a result, the recirculated exhaust gas flow can be controlled only in accordance with the venturi vacuum which is highly reliable as a function of the flow amount of the intake air conducted through the intake passageway into the combustion chamber. This EGR control system makes it possible to effectively decrease NOx emission level without causing the degradation of the driveability of motor vehicles.

However, it has been desired with the above-mentioned EGR control system to effectively lower the volume rate of the recirculated exhaust gas relative to the intake air inducted into the combustion chamber (this rate is referred to as "EGR rate") under a suburban area cruising condition of the motor vehicle on which the EGR control system is mounted. Because, under such a condition, a relatively stable engine operation is maintained to decrease NOx generation in the combustion chamber, and it is eagerly desired to improve fuel consumption or economy and driveability of the vehicle. This desired EGR control mode is particularly effective in a case where the above-mentioned EGR control system is used in combination with a multiple spark plug ignition engine having a plurality of spark plugs in each combustion chamber. In the multiple spark plug ignition engine, the charge in the combustion chamber is combusted within a very short period of time by the action of the multiple sparks to maintain stable engine operation even under a considerably high or heavy EGR rate.

SUMMARY OF THE INVENTION

It is the main object of the present invention to provide an improved EGR control system for an internal combustion engine of a motor-vehicle, by which the emission level of NOx is greatly decreased maintaining high fuel economy and high driveability of the vehicle.

Another object of the present invention is to provide an improved EGR control system for a multiple spark plug ignition internal combustion engine of a motor vehicle, by which EGR rate is suitably controlled to decrease NOx emission level under an urban area operating condition of the vehicle, while the EGR rate is lowered under a surburban area operating condition to maintain high fuel economy and high driveability of the vehicle.

A further object of the present invention is to provide an improved EGR control system for a multiple spark plug ignition internal combustion engine of a motor vehicle, in which EGR rate is lowered at least one of the conditions in which the gear position of the transmission of the engine is in "direct drive" or "overdrive", the vehicle speed is higher than a predetermined level, the engine speed is higher than a predetermined level, and the opening degree of the throttle valve of the engine is larger than a predetermined level.

Other objects, features, and advantages of the EGR control system according to the present invention will be more apparent from the following description taken in conjunction with the accompanying drawings.

DESCRIPTION OF THE PREFERRED EMBODIMENT

Figure 1:
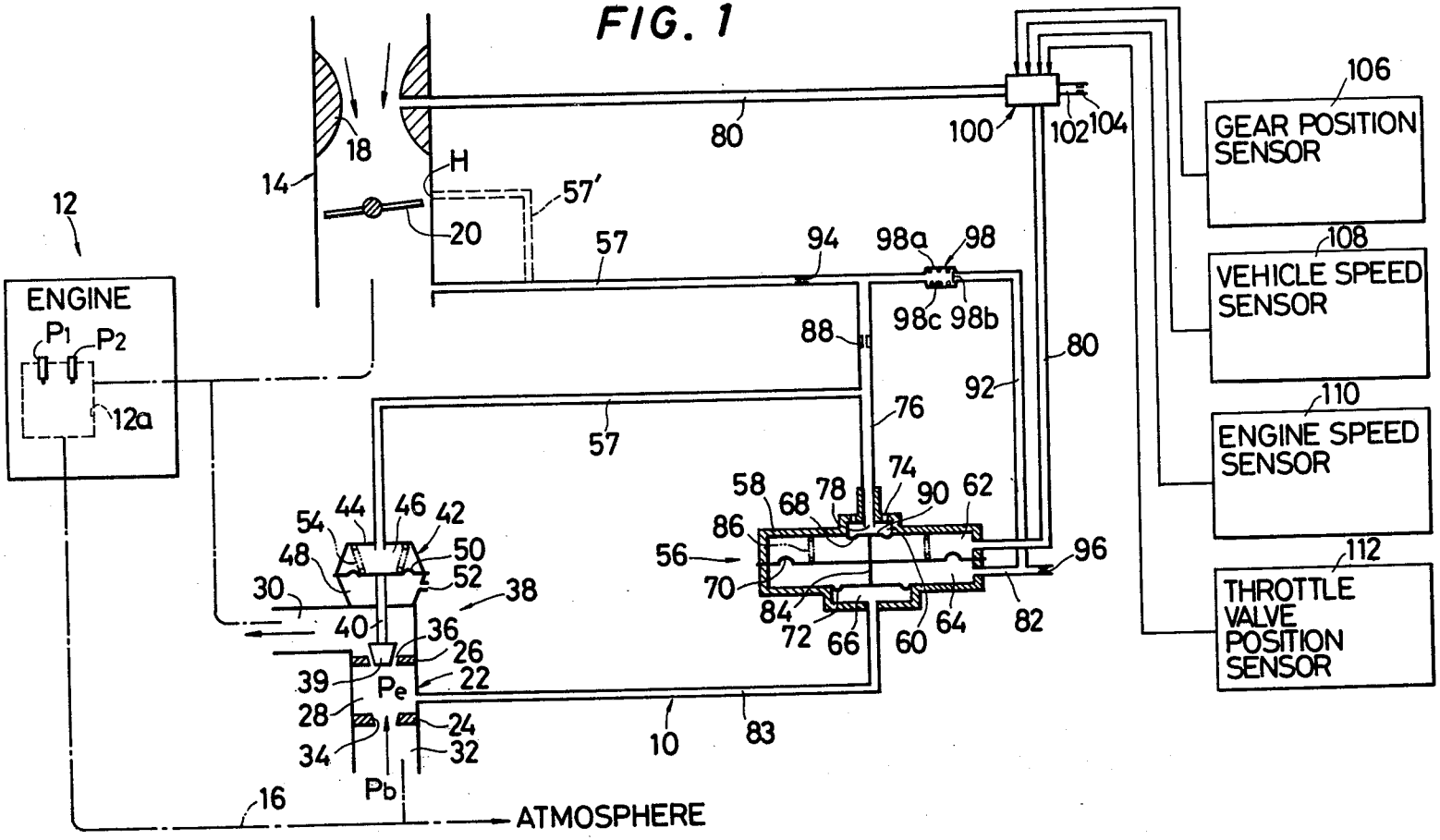
FIG. 1 is a schematic illustration of a preferred embodiment of an EGR control system in accordance with the present invention.

Referring now to FIG. 1 of the drawings, a preferred embodiment of an exhaust gas recirculation (EGR) control system 10 according to the present invention is shown as combined with a multiple spark plug ignition internal combustion engine of a motor vehicle or an automobile. The engine 10 has, as usual, a combustion chamber 21*a* or combustion chambers therein. As shown, two spark plugs $P_1$ and $P_2$ are disposed in the combustion chamber 12*a* to ignite an air-fuel mixture. The air-fuel mixture is supplied to the combustion chamber 12*a* through an intake passageway 14 providing communication between the combustion chamber 12*a* and the atmosphere. The combustion chamber 12*a* is communicable with the atmosphere through an exhaust gas passageway 16 to discharge the exhaust gas from the combustion chamber 12*a* into the atmosphere therethrough. As shown, the intake passageway 14 is provided thereinside with a venturi 18. Rotatably disposed downstream of the venturi 18 is a throttle valve 20 which may form part of a carburetor for preparing the air-fuel mixture.

The EGR control system 10 is composed of an EGR passageway 22 providing communication between the exhaust gas passageway 16 and the intake passageway 14 downstream of the throttle valve 20 for recirculating or conducting engine exhaust gas into the intake passageway 14. The EGR passageway 22 is formed therein with a partition member 24 and a partition member 26 which divides the EGR passageway 22 into an upstream portion 28, 32 and downstream portion 30. In the upstream portion, a chamber 28 is defined between the partition members 24 and 26. The partition member 24 is formed therethrough with an orifice 34 which provides communication between a part 30 and the chamber 28 and forms together with the partition member 24 a restriction of the EGR passageway 22 which controls the flow of recirculated engine exhaust gas. The partition member 24 may not be used if the EGR passageway 22 is provided with any restriction for the flow of exhaust gases which restriction has the similar function to the partition member 24. The partition member 26 or a valve seat is formed therethrough with an aperture or passage 36 which provides communication between the chamber 28 and the downstream portion 30.

An EGR control valve assembly 38 is disposed such that its valve head 39 in the EGR passageway 22 is movable relative to the partition member 26. The valve head 39 is secured to a valve stem 40 extending therefrom externally of the EGR passageway 22. The EGR control valve assembly 38 includes a diaphragm unit 42 for operating the EGR control valve 38. The diaphragm unit 42 is composed of a housing 44 having first and second fluid chambers 46 and 48, and a flexible diaphragm 50 separating the fluid chambers 46 and 48 from each other. The fluid chamber 48 is communicated through a hole 52 with the atmosphere. A spring 54 is provided to normally urge the diaphragm 50 in a direction to cause the valve head 39 to close the aperture 36. In this embodiment, the fluid chamber 46 of the diaphragm unit 42 communicates with the intake passageway 14 downstream of the throttle valve 20 through a passage 57 to receive a suction vacuum in the passageway 14. Alternatively, the fluid chamber 46 may communicate with the intake passageway 14 through a passage 57' indicated in broken lines. The passage 57' opens adjacent the edge of the throttle valve 20 through a hole H which is located just upstream of the uppermost portion of the peripheral edge of the throttle valve at its fully closed position.

A pressure control valve assembly 56 is provided to control the vacuum for operating the EGR control valve 38. The valve assembly 56 comprises a housing 58 having therein four chambers 60, 62, 64 and 66, and three flexible diaphragms 68, 70 and 72. The diaphragm 68 separates the chambers 60 and 62 from each other. The diaphragm 70 separates the chambers 62 and 64 from each other. The diaphragm 72 separates the chambers 64 and 66 from each other. The chamber 60 communicates with the atmosphere through an opening 74 and with the passage 57 through a passage 76 and an inlet port 78. The chamber 62 communicates with the venturi 18 through a passage 80. The chamber 64 communicates through a pipe 82 or a passage with the atmosphere. The chamber 66 communicates with the chamber 28 of the EGR passageway 22 through a passage 83. The diaphragm 70 has a working or pressure sensitive surface area larger than that of each of the diaphragms 68 and 72. The diaphragms 68, 70 and 72 are fixedly connected to each other, for example, by means of a rod 84 so that they are operated as one body. A spring 86 is provided to integrally urge the diaphragms 68, 70 and 72 in a direction opposed to the atmospheric pressure in the chamber 64. An orifice 88 is formed in the passage 57 on the intake passageway side of the junction to which the passage 76 is connected. A control valve 90 is located in the chamber 60 movable relative to the port 78 to control the flow of atmospheric air into the port 78 and is fixedly secured to the diaphragm 68.

A leak passage 92 connects at one end thereof to the passage 57 between the orifices 88 and an orifice 94, and at the other end thereof to the passage 82 which communicates the chamber 64 with the atmosphere. The passage 82 is formed with an orifice 96 thereinside. Operatively disposed in the leak passage 92 is a leak valve 98 which is composed of a casing **98*a* formed integral with the wall of the passage 92, a valve member 98*b* movably disposed in the casing, and a spring 98*c* for normally urging the valve member 98*b* in a direction to close the passage 92. This leak valve 98 is constructed and arranged so that the valve member 98*b* is opened to communicate the passage 57 with the passage 92 when the vacuum applied to the valve member 98*a* exceeds a predetermined level so as to supply the vacuum through the leak passage 92 to the chamber 64**.

A three-way solenoid valve 100 is operatively disposed in the passage 80 connecting the venturi 18 and the chamber 62 of the control valve assembly 38. The solenoid valve 100 is constructed and arranged to take a first position to establish communication between the venturi 18 and the chamber 62 and block communication between the the passage 80 and the atmosphere, and a second position to block communication between the venturi 18 and the chamber 62 and establish communication between the passage 80 and the atmosphere through a pipe or a passage 102. As shown, the pipe 102 is formed thereinside with an orifice 104. The solenoid valve 100 is electrically connected to at least one of a gear position sensor 106 for sensing the gear position in the transmission (not shown) or the gear box of the engine, a vehicle speed sensor 108 for sensing the cruising speed of the vehicle on which the engine is mounted, an engine speed sensor 110 for sensing the engine speed, and a throttle valve position sensor 112 for sensing the opening degree of the throttle valve 20. With this connection, the solenoid valve 100 is energized or actuated to take the second position by the action of the sensors 106 to 112 under at least one of conditions in which the gear position in the transmission is in a range of "top or direct drive" to "overdrive", the vehicle speed is higher than a predetermined level such as a speed ranging from 40 to 60 Km/h, the engine speed is higher than a predetermined level such as an engine speed ranging from 1,400 to 3,000 rpm, and the opening degree of the throttle valve 20 is larger than a predetermined level such as a degree ranging from 12° to 16°.

It is to be noted that the above-mentioned conditions to actuate the solenoid valve 100 are encountered when the motor-vehicle cruises in a surburban area and therefore each above-mentioned each condition to actuate the solenoid valve 100 represents a suburban area cruising condition of the motor vehicle. It will be appreciated from the foregoing, that, when the motor vehicle is operated under an urban area cruising condition, the solenoid valve 100 is de-energized or not actuated to communicate the venturi 18 and the chamber 62 of the control valve assembly 56 without any air bleed through the pipe 102 and therefore the venturi vacuum generated at the venturi is directly supplied to the chamber 62.

The operation of the thus arranged EGR control system 60 will be discussed hereinafter.

Under the urban area cruising condition in which the vacuum generated at the venturi 18 is directly transmitted through the passage 80 to the chamber 62 of the control valve assembly 56 without any air bleed through the pipe 102 into the passage 80, when the venturi vacuum is increased, the diaphragms 68, 70 and 72 are integrally moved so that the valve 90 reduces the degree of opening of the port 78 to reduce the flow of atmospheric air admitted into the passage 76 and therefore the degree of dilution of the suction vacuum conducted into the chamber 46 is reduced. As a result, the degree of opening of the EGR control valve 38 is increased to increase the amount of exhaust gases recirculated into the combustion chamber 12*a* of the engine. This reduces the pressure $P_e$ in the chamber 28 and therefore in the chamber 66 of the valve assembly 56. The decrease in the pressure $P_e$ moves the diaphragms 68, 70 and 72 integrally to increase the degree of opening of the control valve 90 to the port 78 to increase the flow of atmospheric air admitted into the passage 76. As a result, the dilution of the suction vacuum by the atmospheric air is increased to reduce the degree of opening of the EGR control valve 38 to increase the pressure $P_e$ in the chamber 28.

On the contrary, when the venturi vacuum is decreased, the degree of dilution of the suction vacuum conducted into the chamber 46 is increased and accordingly the degree of opening of the EGR control valve 38 is decreased to decrease the amount of exhaust gases recirculated into the combustion chamber 21*a* of the engine. This increases the pressure $P_e$ to increase the pressure in the chamber 66 of the valve assembly 56. As a result, the dilution of the suction vacuum by the atmospheric air is decreased to increase the degree of the opening of the EGR control valve 38 to reduce the pressure $P_e$ in the chamber 28. By the repetition of such operations or such feedback controls, the pressure $P_e$ and the degree of opening of the EGR control valve 38 are converged respectively to values in which the pressure $P_e$ is balanced with the venturi vacuum to increase and reduce the recirculated exhaust gas flow accurately in accordance with the increases and decreases in the venturi vacuum.

With the above-mentioned feedback controls, even if the intake vacuum applied to the diaphragm 50 of the EGR control valve assembly 38 varies with the variation of engine load, the amount of the recirculated exhaust gas is maintained constant as far as the same magnitude of the vacuum signal generated at the venturi 18 is supplied to the chamber 62 of the control valve assembly 56. Additionally, the pressure $P_e$ is not affected by the intake vacuum at the downstream portion 30 of the EGR passageway 22, even if the intake vacuum in the downstream portion 30 varies.

Furthermore, when the pressure $P_e$ in the chamber 28 is varied regardless of the venturi vacuum by variations in the suction vacuum, the EGR control valve 38 is operated to cancel the variations in the pressure $P_e$ by the pressure regulating valve assembly 56. In this instance, when the pressure $P_e$ is a negative pressure and the negative pressure is increased, the diaphragms 68, 70 and 74 are integrally moved to increase the degree of opening of the control valve 90 to the port 78. As a result, the degree of opening of the EGR control valve 38 is reduced similarly as mentioned above to reduce the influence of the suction vacuum on the pressure $P_e$ to restore same to an initial value to prevent the recirculated exhaust gas flow from being varied irrespective of the venturi vacuum.

It will be appreciated from the foregoing that the pressure $P_e$ is controlled to a predetermined level and therefore the recirculated exhaust gas flow is varied only as a function of the venturi vacuum generated at the venturi of the intake passageway.

Under high speed and low load engine operating condition where the NOx emission level is, generally, relatively low, the venturi vacuum generated at the venturi 18 and the intake vacuum downstream of the throttle valve 20 are both considerably high, causing the vacuum applied to the diaphragm 50 of the diaphragm unit 42 to become considerably high. Consequently, the composed vacuum or the sum of the intake vacuum downstream of the throttle valve 20 and the vacuum applied to the diaphragm 50 is increased over a predetermined level such as 120 mmHg and applied to the valve member 98*b* of the leak valve 98. Then, the valve member 98*b* is moved in a direction to open the leak valve 98 against the urging force of the spring 98*c*. As a result, air bleeds through the pipe 82 and the passage 92 into the passage 57 weaken the intake vacuum in the passage 57 and therefore the degree of the vacuum applied to the diaphragm 50 of the diaphragm unit 42 is weakened. Accordingly, the opening degree of the EGR control valve 38 is decreased to decrease the amount of the exhaust gas recirculated back to the combustion chamber 12*a* through the EGR passageway 22.

In this instance, since the leak passage 92 is communicates through the pipe 82 with the chamber 64, a part of the vacuum in the passage 57 is conducted into the chamber 64. Consequently, the conducted vacuum serves to cause the diaphragm 70 to move downwardly so as to increase the opening degree of the control valve 90 to the port 78. This action of the conducted vacuum promotes the control valve 90 to move downward in the drawing. As a result, the decrease of the amount of the recirculated exhaust gas can be more securely accomplished as compared with a case where only atmospheric pressure is supplied to the chamber 64.

It will be appreciated from the foregoing, that a suitable control of the recirculated exhaust gas is carried out under the urban area cruising condition in which the engine load is frequently varied and accordingly NOx emission level is considerably high.

Under the suburban area cruising condition, i.e., under at least one of conditions in which gear position in the transmission is in range of "top" or "overdrive", the vehicle speed is higher than the predetermined level, the engine speed is higher than the predetermined level, and opening degree of the throttle valve 20 is larger than the predetermined level, the communication between the venturi 18 and the chamber 62 of the control valve assembly 56 is blocked and the atmospheric air is introduced into the chamber 62 and accordingly a pressure balance is established between the chamber 62 and the chamber 64 which communicates with the atmosphere through the pipe 82. Accordingly, the control valve assembly 56 is operated only by the pressure in the chamber 66 of the control valve assembly 56. Since the pressure $P_e$ in the chamber 28 is controlled constant by the action of EGR control valve 38, the amount of the recirculated exhaust gas varies in accordance only with the exhaust gas pressure $P_b$ which causes the pressure difference between the chambers 28 and 32. As a result, the amount of the exhaust gas recirculated back to the combustion chamber 12a is controlled to decrease generally in proportion to the exhaust gas pressure $P_b$. It will be appreciated from the foregoing, that EGR rate is decreased to improve the driveability of the vehicle and the fuel consumption of the engine under the suburban area cruising condition in which the variation of engine load is less and the NOx emission level is relatively low.

Figure 2:
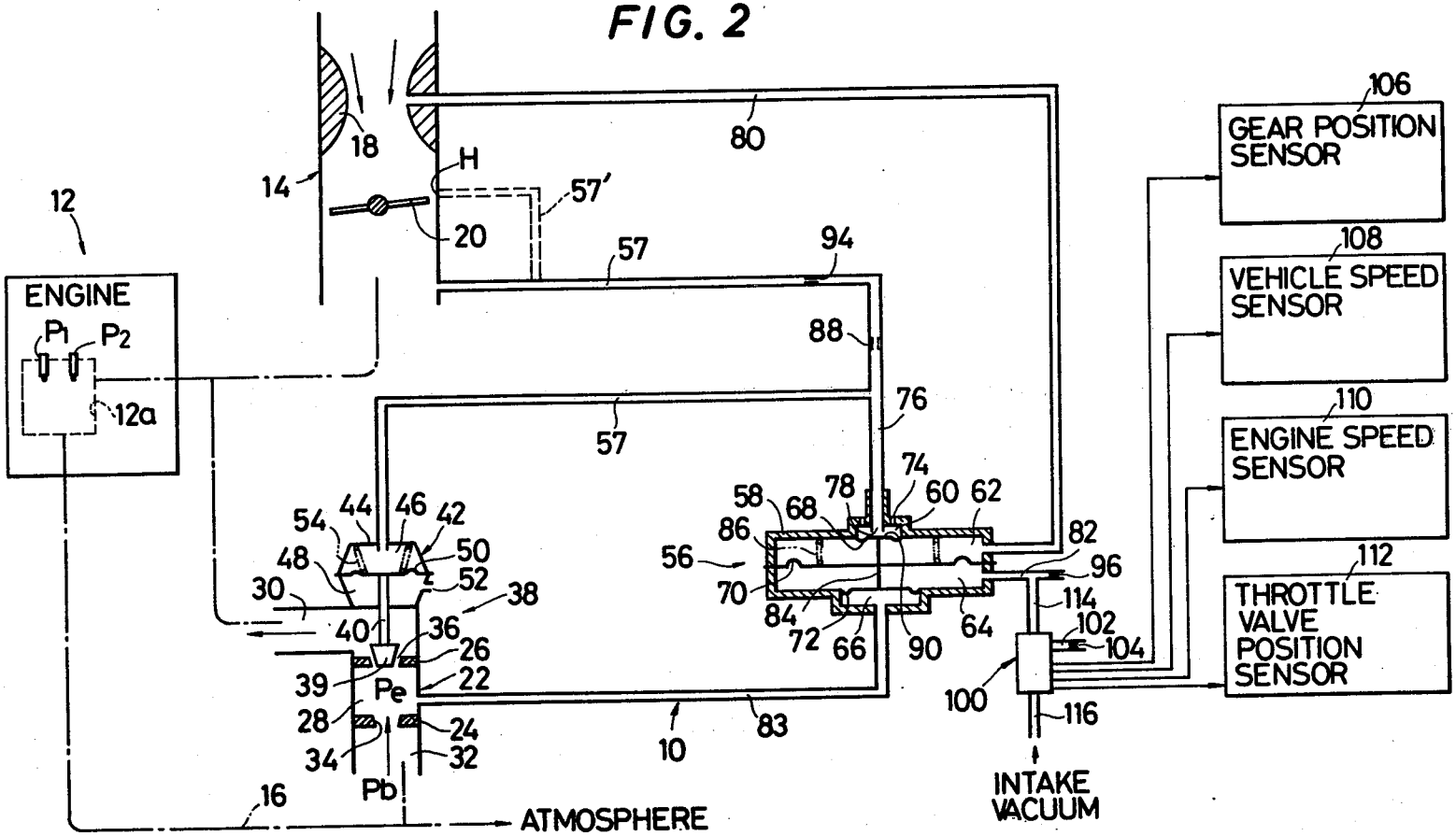
FIG. 2 is a schematic illustration similar to FIG. 1, but shows another preferred embodiment of the present invention.

FIG. 2 illustrates another preferred embodiment of the EGR control system according to the present invention, which is essentially similar to the embodiment of FIG. 1, and, as such, like reference numerals are assigned to corresponding parts for the purpose of simplicity of the description. As shown in FIG. 2, the three-way solenoid valve 100 is disposed between a passage 114 which is connected to the pipe 82 and a passage 116 which is communicated with the intake passageway 14. The passage 116 may be opened to the intake passageway 14 downstream of the throttle valve 20 or the intake passageway 14 through a hole (not shown) located adjacent the hole H.

In this instance, the three-way solenoid valve 100 is constructed and arranged to be energized or actuated by the action of the at least one of the sensors 106 to 112 to establish communication between the passage 114 and the passage 116 and to block communication between the passage 114 and the passage 102 under suburban area cruising condition of the vehicle, i.e., under at least one of the conditions in which the gear position in the transmission is in a range of "top" to "overdrive", the vehicle speed is higher than the predetermined level, the engine speed is higher than the predetermined level, and the opening degree of the throttle valve 20 is larger than the predetermined level. Under operating conditions other than the above-mentioned ones, the three-way solenoid valve 100 is de-energized or not actuated to establish communication between the passage 114 and the passage 102 and block communication between the passage 114 and the passage 116.

With this arrangement, under the urban area cruising condition, the three-way solenoid valve 100 is de-energized and accordingly the chamber 64 of the control valve assembly 56 is supplied with the atmospheric air through the passage 82 and the passage 102. As a result, the control valve assembly 56 is operated to suitably control the amount of the exhaust gas recirculated back to the combustion chamber 12a. On the contrary, under the suburban area cruising condition, the three-way solenoid valve 100 is energized by the action of the sensors 106 to 112 and accordingly the chamber 64 is supplied with the intake vacuum in the intake passageway. Then, the diaphragm 70 of the control valve assembly 56 is urged downward in the drawing, causing the control valve 90 to move downward in the drawing. The downward movement of the control valve 90 increases the amount of air bled into the passage 76. As a result, the intake vacuum applied to the diaphragm 50 of the diaphragm unit 42 is weakened and therefore the opening degree of the EGR control valve 38 is decreased to decrease the amount of the exhaust gas recirculated back to the combustion chamber 12a.

Figure 3:
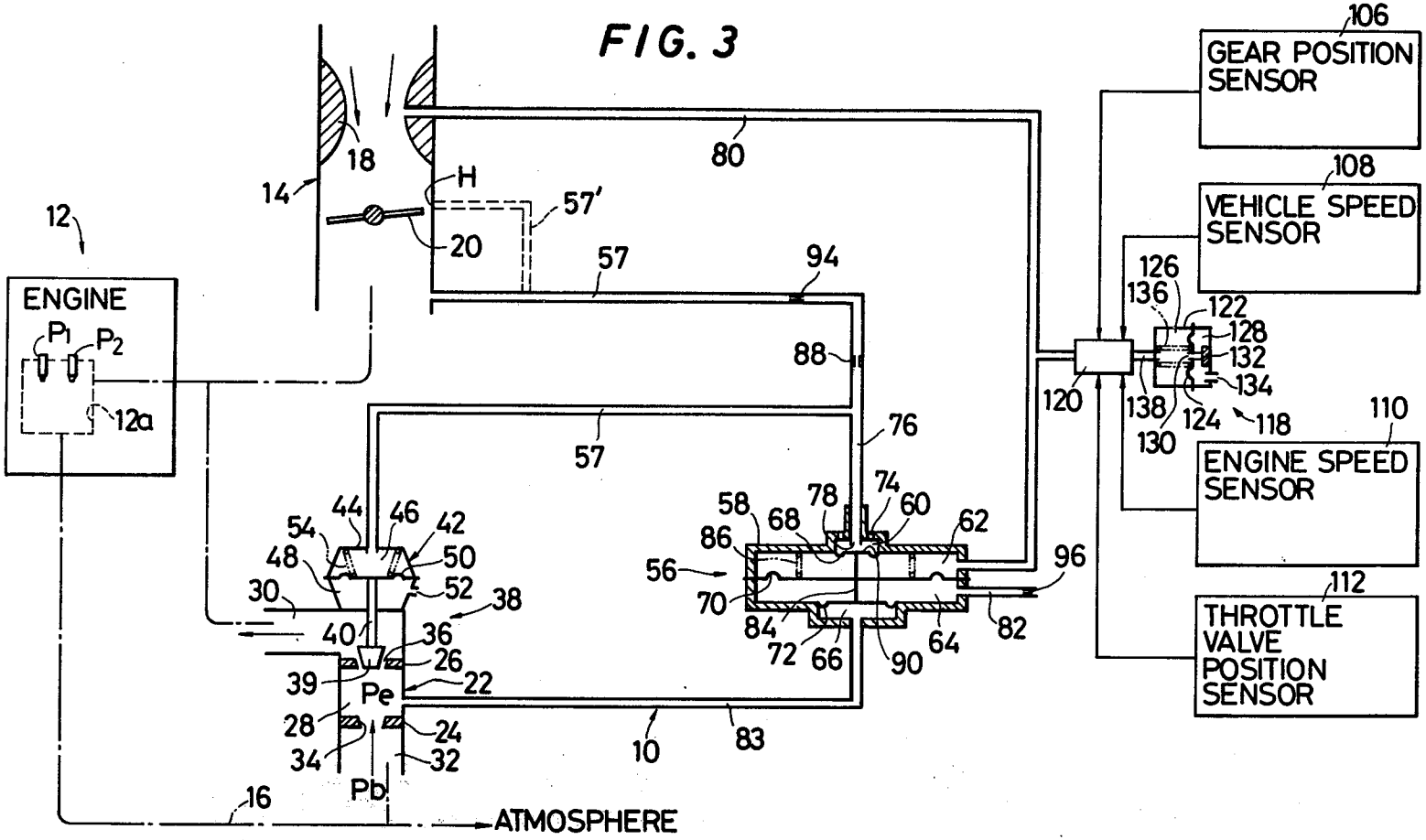
FIG. 3 is a schematic illustration similar to FIG. 1, but shows a further preferred embodiment of the present invention.

FIG. 3 illustrates a further embodiment of the EGR control system according to the present invention, which is essentially similar to the embodiment of FIG. 1 and accordingly like reference numerals represent like parts.

As shown in FIG. 3, a relief valve 118 is fluidly connected through a solenoid valve 120 to the passage 80. The relief valve 118 consists of a casing 122 in which a diaphragm member 124 is secured to divide the inside of the casing into a vacuum chamber 126 and an atmospheric chamber 128. The diaphragm member 124 is provided with a pipe 130 or a passage which is seatable on an elastomeric member 132 or a seat member secured to the inner surface of the casing defining the atmospheric chamber 128. The atmospheric chamber 128 communicates through an air inlet 134 with the atmosphere. A spring 136 is disposed in the vacuum chamber 126 to normally urge the diaphragm 124 in a direction for the pipe member 130 to contact the elastomeric member 132. The spring 136 is arranged to be compressed to separate the pipe 130 from the resilient member 132 when a vacuum higher than a predetermined level is applied through the solenoid valve 120 to the diaphragm 124.

The solenoid valve 120 is constructed and arranged to be energized or actuated by the action of the sensors 106 to 112 to be opened to establish communication between the passage 80 and the vacuum chamber 126 of the relief valve 118 through a passage 138 under the suburban area cruising condition, i.e., under at least one of the conditions in which the gear position in the transmission is in a range of "top" to "direct drive", the vehicle speed is higher than the predetermined level, the engine speed is higher than the predetermined level, and the opening degree of the throttle valve 20 is larger than the predetermined level. Under operating condition other than the above-mentioned suburban area cruising condition, the solenoid valve 120 is de-energized or de-actuated to close to block communication between the passage 80 and the chamber 126 of the relief valve 118.

With the arrangement shown in FIG. 3, under the suburban area cruising condition, the solenoid valve 120 is energized and opened to establish communication between the passage 80 and the vacuum chamber 126 of the relief valve 118 and accordingly the venturi vacuum is supplied to the vacuum chamber 126. In this state, when the venturi vacuum applied to the diaphragm 124 is higher than the predetermined level, the spring 136 is compressed to separate the pipe 130 from the resilient member 132. Then, atmospheric air is introduced through the air inlet 134 and the the pipe 130 into the vacuum chamber 126. The introduced air is supplied through the solenoid valve 120 into the passage 80 and consequently the degree of the venturi vacuum supplied to the chamber 62 of the control valve assembly 56 is weakened. As a result, the amount of air bled into the passage 76 is increased to decrease the amount of the exhaust gas recirculated back to the combustion chamber 12a.

When the venturi vacuum applied to the diaphragm 124 is lower than the predetermined level, the spring 136 can not be compressed and consequently atmospheric air is not supplied to the passage 80 althrough the solenoid valve 120 is establishing communication between the passage 80 and the vacuum chamber 126 of the relief valve 118. As a result, a suitable control of the recirculated exhaust gas is accomplished to suppress the generation of NOx in the combustion chamber 12a.

It will be understood from the foregoing, that under urban area cruising condition of the vehicle, the solenoid valve 120 is de-energized to be closed to carry out a suitable control of the exhaust gas recirculated back to the combustion chamber 12*a* causing NOx emission to decrease to a desired level.

While the solenoid valve 120 has been shown and described to be fluidly connected to the passage 80, the solenoid valve 120 may be fluidly connected to the passage 57 upstream of the orifice 88, in which the solenoid valve 120 may be constructed and arranged to be opened to establish communication between the passage 57 and the atmosphere under at least one of the conditions in which the gear position of the transmission is in a range of "top" to "overdrive", the vehicle speed is higher than the predetermined level, the engine speed is higher than the predetermined level, and the opening degree of the throttle valve 20 is larger than the predetermined level. It will be appreciated that, also with the solenoid valve 120 arranged as above, the intake vacuum applied to the diaphragm 50 of the diaphragm unit 42 is weakened and therefore the amount of EGR gas can be decreased.

Experiments reveal that a particularly significant effect is obtained when the EGR control system according to the present invention is used in combination with a multiple spark plug ignition engine having a plurality of spark plugs in each combustion chamber which engine requires to be fed with a considerably large amount of the exhaust gas.

What is claimed is:

1. An exhaust gas recirculation (EGR) control system in combination with an internal combustion engine of a motor-vehicle including a combustion chamber, an intake passageway providing communication between the atmosphere and the combustion chamber, a venturi formed in the intake passageway, a throttle valve rotatably disposed in the intake passageway downstream of the venturi, and an exhaust gas passageway providing communication between the combustion chamber and the atmosphere, said EGR control system comprising:

EGR passageway means providing communication between the exhaust gas passageway and the intake passageway for recirculating exhaust gas back to the combustion chamber;

a diaphragm actuated EGR control valve operatively disposed in said EGR passageway means to divide said EGR passageway means into an upstream portion connecting to the exhaust gas passageway and a downstream portion connecting to the intake passageway, said EGR control valve being operative in opposite directions to increase and decrease the pressure of the exhaust gas in the upstream portion of said EGR passageway means to control the flow of the recirculated exhaust gas, the diaphragm of said EGR control valve defining a first chamber which communicates through first passage means with the intake passageway to provide the first chamber with an intake vacuum in the intake passageway;

control means for controlling the intake vacuum provided to the first chamber of said EGR control valve to increase and decrease the exhaust gas pressure in the upstream portion of said EGR passageway means in accordance with a decrease and an increase in the exhaust gas pressure in the upstream portion, respectively, and in accordance with a decrease and an increase in a vacuum in said venturi, respectively; and means for decreasing the degree of the intake vacuum provided to the first chamber of said EGR control valve under a suburban area cruising condition of the vehicle.

2. An EGR control system as claimed in claim 1, in which said control means comprises.

second passage means connecting to said first passage means and having an inlet port communicating with the atmosphere for bleeding atmospheric air into said second passage means to dilute the vacuum in said first chamber, a pressure regulating valve located with a head movably relative to said inlet port of said second passage means for controlling the flow of atmospheric air bled through said inlet port into said second passage means, and operating means operatively connected to said pressure regulating valve so that said pressure regulating valve reduces and increases the bleed of atmospheric air through said inlet port in response to an increase and a decrease in said venturi vacuum, respectively and in response to an increase and a decrease in the exhaust gas pressure in the upstream portion of said EGR passageway means to reduce and increase the dilution of the intake vacuum provided to said first chamber respectively.

3. An EGR control system as claimed in claim 2, in which said operating means comprises a first flexible diaphragm defining a second chamber communicating with said venturi through a third passage means to receive said venturi vacuum therefrom; and a second flexible diaphragm defining a third chamber communicating with the upstream portion of EGR passageway means to receive the exhaust gas pressure therefrom, said second flexible diaphragm being fixedly connected to said first diaphragm, said first and second diaphragms being operatively connected to said pressure regulating valve so that said pressure regulating valve is operated to reduce and increase the flow of atmospheric air through said inlet port in response to an increase and a decrease in said venturi vacuum provided in said second chamber, respectively, and in response to an increase and a decrease in the exhaust gas pressure provided in said third chamber, respectively.

4. An EGR control system as claimed in claim 3, in which the intake vacuum decreasing means includes urging means for urging said first flexible diaphragm in a direction to cause said pressure regulating valve to move to increase the flow of atmospheric air through said inlet port.

5. An EGR control system as claimed in claim 4, in which said urging means includes valve means fluidly connected to said third passage means, said valve means being operable to establish communication between said third passage means and the atmosphere when actuated, and actuating means for actuating said valve means when the vehicle is operated under the suburban area cruising condition.

6. An EGR control system as claimed in claim 5, in which said actuating means includes at least one of a gear position sensor, a vehicle speed sensor, an engine speed sensor, and a throttle valve position sensor, in which said actuating means are arranged to actuate said valve means under at least one of the conditions in which the gear position in the transmission of the engine is in a range of "direct drive" to "overdrive" the vehicle speed is higher than a predetermined level, the engine speed is higher than a predetermined level, and the degree of the throttle valve is larger than a predetermined level.

7. An EGR control system as claimed in claim 6, in which said valve means includes a three-way solenoid valve which is arranged to establish communication between the venturi and the second chamber of said operating means and block communication between the third passage means and the atmosphere when de-actuated, while to block communication between the venturi and the second chamber and establish communication between the second chamber and the atmosphere when actuated.

8. An EGR control system as claimed in claim 6, further comprising a fourthe passage means for communication between the atmosphere and a fourth chamber defined between said first and second flexible diaphragms, a fifth passage means fluidly connecting the first passage means to said fourth passage means, and leak valve means operatively disposed in said fifth passage means and arranged to bleed atmospheric air through said fourth and fifth passage means into the first passage means when an intake vacuum in the first passage means is higher than a predetermined level.

9. An EGR control system as claimed in claim 8, in which said leak valve means includes a casing, a valve member movably disposed within said casing to be closable to block communication between the first passage means and the fourth passage means, and a spring member disposed within said casing to urge the valve member to close, said spring member being arranged to be compressed to open said valve member to allow communication between the first passage means and the fourth passage means.

10. An EGR control system as claimed in claim 6, in which said valve means includes a solenoid valve which is arranged to establish communication between the venturi and the second chamber of said operating means and block communication between the third passage means and the atmosphere when de-actuated, while to be capable of establishing communication between the third passage means and the atmosphere when actuated.

11. An EGR control system as claimed in claim 10, further comprising relief valve means which is fluidly communicable with the third passage means through said solenoid valve actuated, said relief valve means being arranged to be capable of establishing communication between the third passage means and the atmosphere when vacuum in the third passage means is higher than a predetermined level.

12. An EGR control system as claimed in claim 11, in which said relief valve means includes a casing, a diaphragm member dividing the inside of the casing into an atmospheric chamber communicating with the atmosphere and a vacuum chamber communicable through said solenoid valve with the third passage means, a passage means formed with said diaphragm member through which said vacuum chamber is communicable with said atmospheric chamber, a seat member securely disposed in the atmospheric chamber which seat member said passage means is seatable to block communication between the vacuum chamber and the atmospheric chamber, and a spring member disposed in said vacuum chamber to urge said diaphragm member in a direction for said passage means to seat on said seat member, said spring being arranged to be compressed to separate said passage means from said seat member when a vacuum applied on said diaphragm member is higher than a predetermined level.

13. An EGR control system as claimed in claim 4, in which said urging means includes valve means fluidly communicating with a fourth chamber which is defined between said first and second flexible diaphragms of said operating means, said valve means being operable to establish communication between the fourth chamber and the intake passageway when actuated, and actuating means for actuating said valve means when the vehicle is operated under the suburban area cruising condition.

14. An EGR control system as claimed in claim 13, in which said actuating means includes at least one of a gear position sensor, a vehicle speed sensor, an engine speed sensor, and a throttle valve position sensor, in which said actuating means are arranged to actuate the valve means under at least one of the conditions in which the gear position in the transmission is in a range of "direct drive" to "overdrive", the vehicle speed is higher than a predetermined level, the engine speed is higher than a predetermined level, and the opening degree of the throttle valve is larger than a predetermined level.

15. An EGR control system as claimed in claim 14, in which said valve means includes a three-way solenoid valve which is arranged to block communication between the fourth chamber and the intake passageway and establish communication between the fourth chamber and the atmosphere when de-actuated, while establishing communication between the fourth chamber and the intake passageway and blocking communication between the fourth chamber and the atmosphere when actuated.

16. An EGR control system as claimed in claim 1, in which the internal combustion engine includes a plurality of spark plugs disposed in the combustion chamber.

17. An EGR control system as claimed in claim 16, in which said plurality of spark plugs is two spark plugs.

* * * * *